US005664516A

United States Patent [19]

Breeden

[11] Patent Number: 5,664,516

[45] Date of Patent: Sep. 9, 1997

[54] PERSONAL WATERCRAFT CARRYING APPARATUS AND MTHOD FOR TRAILERABLE BOATS

[76] Inventor: Gray Breeden, 11005 Burnet Rd., Ste. 114-299, Austin, Tex. 78757

[21] Appl. No.: 662,063

[22] Filed: Jun. 12, 1996

[51] Int. Cl.[6] ..... B63B 35/40

[52] U.S. Cl. ..... 114/259; 414/462; 280/414.1; 114/344

[58] Field of Search ..... 114/258–263, 344; 414/537, 538, 562; 280/414.1, 414.2

[56] References Cited

U.S. PATENT DOCUMENTS

| | | | |
|---|---|---|---|
| 4,864,957 | 9/1989 | Edgar et al. | 114/258 |
| 4,960,356 | 10/1990 | Wrenn | 414/537 |
| 5,005,846 | 4/1991 | Taylor | 280/30 |
| 5,016,893 | 5/1991 | Hart | 280/35 |
| 5,249,545 | 10/1993 | Gettman | 114/259 |
| 5,443,028 | 8/1995 | Keen | 114/248 |

OTHER PUBLICATIONS

Water Ski Magazine, Lift On, Nov./Dec. 1992, p. 74, Author Unknown.

Water Ski Magazine, Rig of the Month, May, 1995, p. 14, Author Unknown.

Water Ski Magazine, Hitching a Ride, Aug., 1995, p. 16, Author Unknown.

*Primary Examiner*—Jesus D. Sotelo

*Attorney, Agent, or Firm*—Shaffer & Culbertson; Russell D. Culbertson

[57] ABSTRACT

A personal watercraft carrier (10) is adapted to be mounted on a trailerable boat (B) to facilitate transporting a personal watercraft (P) along with the trailerable boat. The carrier (10) includes two parallel support rails (12), two parallel loading rails (14) connected to the support rails, and support structures (24, 26) for both the support rails and the loading rails. The carrier (10) may be connected to the boat (B) by the rail support structures (24, 26) with the loading rails (14) leading down to a position beyond the stern of the boat and slightly above the boat water line (W). A winch (72) associated with the boat (B) or the carrier (10) may be used to pull the personal watercraft (P) forward first onto the loading rails (14) and, ultimately, onto the support rails (12) where the personal watercraft may be secured for transport with the boat.

12 Claims, 3 Drawing Sheets

PERSONAL WATERCRAFT CARRYING APPARATUS AND MTHOD FOR TRAILERABLE BOATS

BACKGROUND OF THE INVENTION

This invention relates to personal watercraft carriers or shuttles and particularly, to a carrier which allows a personal watercraft to be transported with a trailerable boat. The invention also includes a method of loading a personal watercraft for transport on a trailerable boat.

The term "personal watercraft" refers to a class of watercraft designed to carry one to three passengers in a standing position or seated in tandem with a seat similar to a motorcycle seat. As used herein, "personal watercraft" refers to any of the class of one to three passenger, motorized watercraft with tandem seating as in a motorcycle or with the user standing or kneeling on the vehicle.

Personal watercraft are commonly stored at home and transported to a lake or other water recreation area for use. For transport, the personal watercraft may be trailered with a special trailer designed to accept one or more of the vehicles. One or more personal watercraft may also be carried in the bed of a pick-up. Special carriers such as that shown in U.S. Pat. No. 4,960,356 to Wrenn facilitate carrying personal watercraft in the bed of a pick-up.

A problem arises when the personal watercraft owner does not own a pick-up and desires to transport a regular, trailerable power boat in addition to the personal watercraft. One solution to this problem is shown in the product known as the "PWC POWER LIFT" by Sport Boat Trailer of Menlo Park, Calif. The "PWC POWER LIFT" device includes a personal watercraft carrier connected by long, pivoting arms to the trailer for a trailerable boat. The pivoting arms are lowered to put the personal watercraft carrier in position to load and unload the personal watercraft, and then pivoted upwardly with a hydraulic ram to position the carrier and loaded personal watercraft above the boat loaded on the trailer. Although this solution allows the personal watercraft and regular power boat to be trailered at the same time, the solution is costly, heavy, and requires a powerful lifting mechanism. Also, since the personal watercraft is carried on the trailer, it may not be carried across water on the trailerable boat.

SUMMARY OF THE INVENTION

It is an object of the present invention to provide a personal watercraft carrying apparatus and method that overcomes the above-described problems and others associated with transporting personal watercraft. More particularly, it is an object of the invention to provide a personal watercraft carrier that allows a personal watercraft to be transported along with a trailerable boat, and that facilitates easy loading and unloading.

To accomplish this object, the personal watercraft carrier according to the invention is adapted to mount directly to a trailerable boat at the rear or aft section of the boat. The carrier includes a support structure for supporting the personal watercraft above the boat during transport and a loading structure allowing the personal watercraft to be raised and lowered to and from the support structure both while the boat is on the trailer or while the boat is in the water. Mounting the carrier directly on the boat allows the personal watercraft to be transported along with a trailerable boat without the need for a special vehicle capable of carrying the personal watercraft separately. Also, the carrier according to the invention does not require any elaborate lifting structure as required in the "PWC POWER LIFT" device, which mounted the personal watercraft carrier to the boat trailer.

The personal watercraft carrier according to the invention is adapted to be used with trailerable power boats having an inboard mounted engine. Such power boats include inboard/outboard type boats and inboard boats as well. The trailerable boat may be jet or prop driven.

The preferred form of the carrier includes two parallel support rails and two parallel loading rails mounted longitudinally on the boat. A forward support structure or means is associated with the support rails and supports the support rails at a position above an aft section of the boat. A loading rail support structure or means supports the loading rails so that the loading rails extend rearwardly over the stern of the boat and downwardly to just above the water line of the boat. Both sets of rails are spaced apart sufficiently to support the personal watercraft along opposite sides of its hull. A winch is associated with the boat or with the carrier in position to winch the personal watercraft onto the loading and support rails.

To load the personal watercraft while the trailerable boat is in the water, the personal watercraft is first positioned at the stern of the boat with the bow of the personal watercraft facing the stern of the boat and aligned with the loading rails. The next step in the loading process involves extending the cable or strap from the winch and connecting the strap to the bow of the personal watercraft. The personal watercraft may then be winched onto the loading rails, and ultimately onto the support rails where the personal watercraft resides during transit. Loading the personal watercraft carrier according to the invention while the boat is trailered requires positioning the personal watercraft near the level of the loading rails using a suitable personal watercraft stand or other device. From this position the personal watercraft is winched onto the loading and support rails just as if the watercraft was loaded from the water.

Once the personal watercraft is loaded on the support rails of the carrier, it may be secured in place by any suitable means for transit with the trailerable boat. The trailerable boat may then be trailered on its standard trailer just as if the carrier and personal watercraft were not present.

The preferred form of the invention also includes a lifting member extending between the loading rails at a lower or aft end of the rails. The lifting member is positioned below the plane of the rails and forward of the aft end of the loading rails in position to contact the bow of the personal watercraft prior to contact between the loading rails and the personal watercraft hull. Contact between the personal watercraft bow and the lifting member as the winch pulls the personal watercraft forward, lifts the personal watercraft upwardly so that the personal watercraft hull may slide smoothly onto the loading rails.

These and other objects, advantages, and features of the invention will be apparent from the following description of the preferred embodiments, considered along with the accompanying drawings.

DESCRIPTION OF THE PREFERRED EMBODIMENTS

Figure 1:
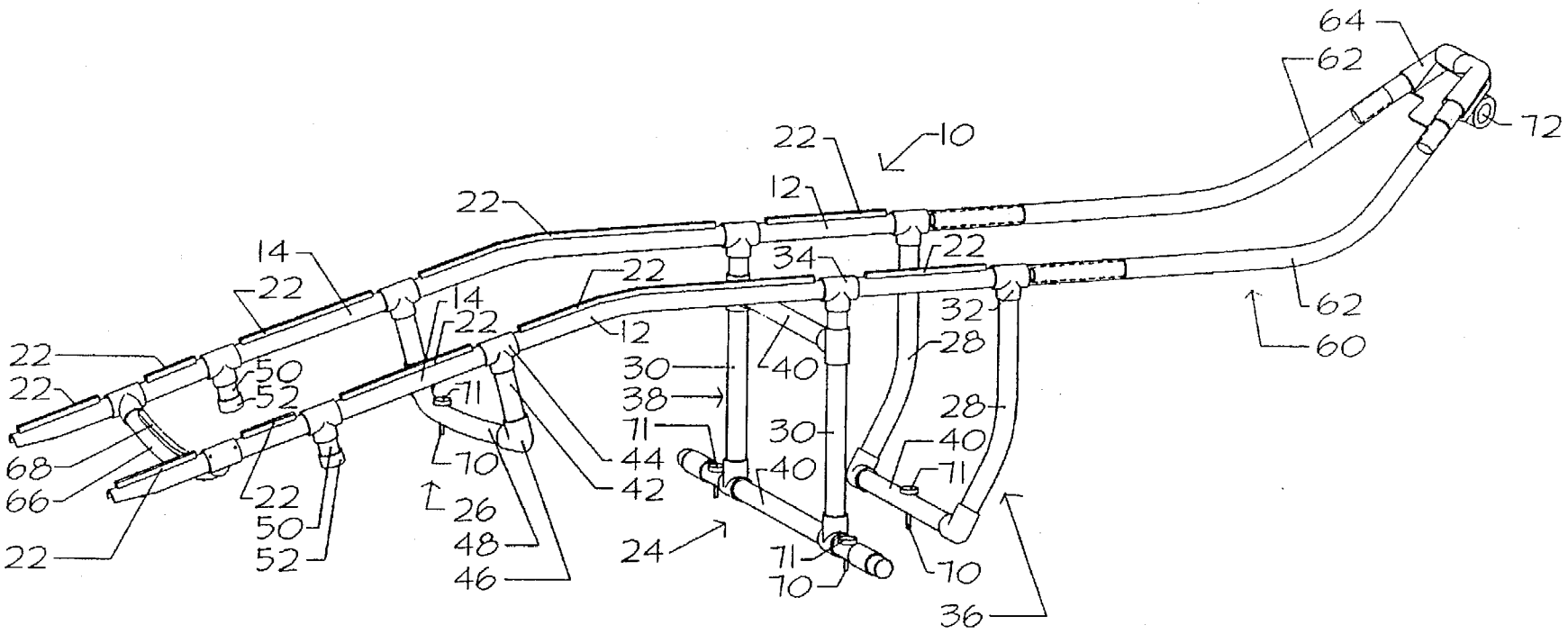
FIG. 1 is an isometric view of a personal watercraft carrier embodying the principles of the invention.
Figure 2:
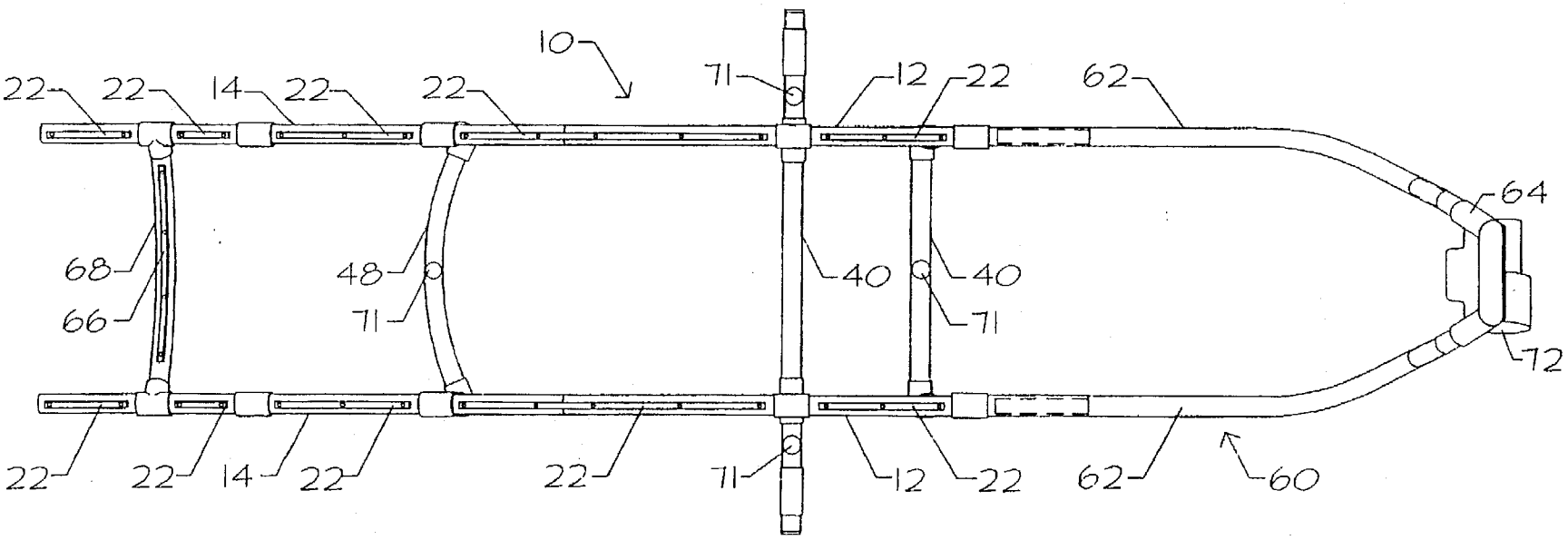
FIG. 2 is a top view of the personal watercraft carrier shown in FIG. 1.
Figure 3:
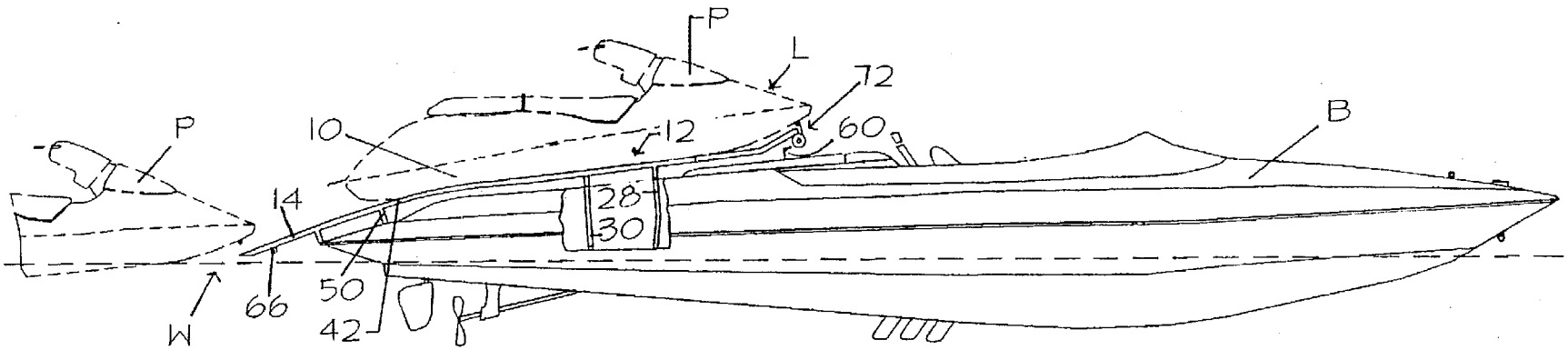
FIG. 3 is a side elevation of a personal watercraft carrier as shown in FIGS. 1 and 2 with the carrier mounted on a trailerable boat, with portions of the boat cut away to show the carrier connection to the boat, and with a personal watercraft shown in phantom in various positions.

FIGS. 1 through 3 illustrate a personal watercraft carrier 10 embodying the principles of the invention. Referring particularly to FIGS. 1 and 2 the carrier 10 includes two parallel support rails 12 and two parallel loading rails 14. Each loading rail 14 is connected at a forward end to an aft end of one of the support rails 12 and extends at an acute angle downwardly with respect to the respective support rail. The support and loading rails 12 and 14, respectively, may be integrally formed from a single piece of material bent or otherwise formed to produce the desired angled relationship or may be separately formed and connected by a suitable connecting structure.

Both the support rails 12 and loading rails 14 are spaced apart a distance that will enable the rails to support a personal watercraft P (FIG. 3) by extending along opposite sides of the personal watercraft hull. The rails 12 and 14 preferably include slide means for facilitating a sliding movement of the personal watercraft hull along the rails. In the preferred form of the invention, the slide means includes strips of TEFLON plastic or other suitable, low friction material 22 connected along the top side of the loading and support rails 14 and 12, respectively. Alternatively, the rails may include a roller structure (not shown) for facilitating the movement of the personal watercraft hull longitudinally along the rails 12 and 14.

Forward support means 24 are connected to and depend from the support rails 12 while loading rail support means 26 depend from the loading rails 14, both in position to support the rails above a boat to which the carrier 10 may be connected. The forward support means 24 preferably includes first and second support elements 28 and 30, each having a proximal end 32 and 34, respectively, connected to the bottom of the support rails 12 and a distal end 36 and 38 extending downwardly. A forward cross member 40 or cross support means is preferably associated with each of the first and second supports 28 and 30 for fixing the distance between the support rails 12. The loading rail support means includes one support structure 42 with a proximal end 44 connected to the bottom of the loading rails 14 and a distal end 46 extending downwardly with a third cross member 48 fixing the distance between the members making up the loading rail support structure, and thus, the distance between the loading rails. In the illustrated form of the invention, the loading rail support means 26 also includes short support members 50 simply extending downwardly from the loading rails 14 with a protecting pad 52 at their respective distal end.

The preferred form of the carrier 10 illustrated in the figures also includes a forward stop structure 60 connected to the support rails 12. The forward stop structure 60 limits the forward movement of the personal watercraft along the support rails 12. The illustrated stop structure 60 includes two members 62, each member connected to a different one of the support rails 12 and extending forwardly from the support rails and upwardly and inwardly with respect to the support rails. A suitable connecting structure 64 connects the two stop members 62 at a forward end thereof.

The preferred form of the invention also includes a lifting member 66 which assists in the process of loading the personal watercraft onto the loading and support rails 14 and 12, respectively. The lifting member 66 is positioned between the loading rails 14 near an aft end of the rails, with a portion bowing below the plane defined by the loading rails. A strip of TEFLON plastic material or other suitable friction reducing material 68 is preferably positioned along a top edge of the lifting member 66. Alternatively, the lifting member 66 may include rollers (not shown) centered thereon between the loading rails 14. The function of the lifting member 66 will be discussed below with reference to FIG. 3.

The rails 12 and 14 and the various members which make up the support means 24 and 26 and cross members 40 and 48 may be formed from any suitable material and may be connected in any suitable manner. In the preferred form of the invention, the rails and structural members are all made from an aluminum tubing, although plastics may be used within the scope of the invention. The various elements may be connected by welded or bolted collars as shown in the figures or by any other suitable arrangement.

To facilitate connecting the carrier 10 to a boat B as shown in FIG. 3, the carrier 10 includes aft and forward connecting means associated with both the forward and loading rail support means 24 and 26, respectively. The aft and forward connecting means preferably includes threaded members 70 with a suitable handle 71 to allow the members to be threaded by hand. The threaded connectors 70 are adapted to cooperate with threaded receptacles (not shown) attached at appropriate locations to the boat B upon which the carrier 10 is to be mounted. Although the threaded connectors 70 are preferred, those skilled in the art will readily appreciate that the carrier 10 may be secured to a trailerable boat B by any suitable means.

Referring now to FIG. 3, the carrier 10 according to the invention requires a winch 72 or a similar device for loading and unloading the personal watercraft. The winch 72 may be mounted directly on the boat B or mounted on the carrier 10 as shown in FIG. 3. When mounted on the carrier 10, the winch 72 is preferably connected to the stop structure 60 at the forward end of the support rails 12. Regardless of where the winch 72 is located, the winch may be hand operated or powered by a suitable mechanism such as an electric motor.

The method of loading a personal watercraft P on the carrier 10 according to the invention may be described with reference to FIG. 3. FIG. 3 shows the carrier 10 connected in an operating position on the boat B. When the trailerable boat B is in the water, the personal watercraft P must first be positioned behind the boat with the bow of the personal watercraft facing the stern of the boat and with the personal watercraft aligned with the carrier 10. When aligned with the carrier 10, the personal watercraft P is positioned with its longitudinal axis centered between the loading rails 14 of the carrier. With the personal watercraft P in this aligned, starting position shown in phantom at the left of FIG. 3, the method includes extending the winch strap (not shown) and connecting the strap to the bow of the personal watercraft. The personal watercraft P may then be winched forward first onto the loading rails 14 and then to the support rails 12 to the position L shown in phantom in FIG. 3. When the personal watercraft P is finally in position L, it may be tied down by a suitable means to the boat B or to the carrier 10 for secure transport with the boat.

With the lifting member 66 positioned between the loading rails 14, when the personal watercraft P is first winched toward the aft end of the loading rails, the bow of the personal watercraft contacts the lifting member. The contact between the curved bow and the lifting member 66 as the personal watercraft P is winched forward raises the bow of the personal watercraft upwardly, lifting the personal watercraft up to the level of the aft end of the loading rails 14. This initial lifting, occasioned by the lifting member 66, allows the aft end of the loading rails 14 to reside above the water line W of the trailerable boat B and still facilitate easy loading.

When the boat B is trailered, the personal watercraft P may be loaded from a level below the level of the loading rails 14 just as when the boat is in the water. Thus, when the boat B is trailered, the personal watercraft P must be positioned on a suitable stand or storage device (not shown) at the appropriate level for beginning the loading procedure.

The carrier 10 according to the invention allows a personal watercraft P to be unloaded directly into the water when the boat B is in the water, or onto a storage stand when the boat is trailered. The unloading step includes first untying the personal watercraft P if it has been tied for secure transport, and then sliding the personal watercraft rearwardly, preferably using the winch 72 and its associated strap to control the movement of the personal watercraft as it moves along the downwardly angled loading rails 14.

The above described preferred embodiments are intended to illustrate the principles of the invention, but not to limit the scope of the invention. Various other embodiments and modifications to these preferred embodiments may be made by those skilled in the art without departing from the scope of the following claims. For example, although the carrier 10 is described above as having spaced apart rails and slide means, a series of spaced apart rollers could be employed to provide the desired sliding support for a personal watercraft hull. Such an arrangement of spaced apart rollers is to be considered an equivalent of the spaced apart rails and slide means.

I claim:

1. A personal watercraft carrier for use with a trailerable boat which has an inboard mounted engine, the carrier comprising:

(a) two elongated support rails extending substantially parallel to each other and spaced apart sufficiently to contact opposite sides of the hull of a personal watercraft when the personal watercraft is aligned longitudinally with the support rails;

(b) two elongated loading rails, each loading rail connected to a different one of the support rails at an aft end of the respective support rail, the two loading rails extending substantially parallel to each other at an acute angle downwardly from the support rails, and also being spaced apart substantially the same distance as the two support rails;

(c) cross support means associated with both the support rails and the loading rails for fixing the support rails and loading rails in the spaced apart position;

(d) forward support means having a proximal end connected to the support rails and a distal end depending from the support rails in position to contact a surface on the trailerable boat when the carrier is in an operating position, and to support the weight of the carrier and a personal watercraft positioned on the support rails;

(e) forward connector means associated with the distal end of the forward support means for connecting the distal end of the forward support means to the trailerable boat;

(f) loading rail support means having a proximal end connected to the loading rails and a distal end depending from the loading rails in position to contact an aft surface of the trailerable boat when the carrier is in the operating position, the loading rails extending rearwardly beyond the stern of the boat and above the water line of the boat when the carrier is in the operating position;

(g) aft connector means associated with the distal end of the loading rail support means for connecting the loading rail support means to the trailerable boat; and (h) slide means associated with the loading rails and the support rails for facilitating sliding contact between the hull of the personal watercraft and the loading rails and support rails, longitudinally along said rails.

2. The apparatus of claim 1 further including:

(a) a forward stop structure connected to a forward end of the support rails, the forward stop structure for limiting the movement of the personal watercraft along the support rails at the ends thereof opposite the ends connected to the loading rails.

3. The apparatus of claim 2 further including:

(a) a winch connected to the forward stop structure and having a strap of sufficient length to extend from the forward stop structure to beyond the aft end of the loading rails.

4. The apparatus of claim 1 further comprising:

(a) a lifting member positioned between the loading rails and spaced forward from the aft end of the loading rails and below a plane defined by the loading rails.

5. The apparatus of claim 1 wherein:

(a) the forward support means includes a first forward support element depending from the support rails, and a second forward support element depending from the support rails in a spaced apart relation to the first forward support element; and (b) the cross support means includes a first cross member extending transversely to the loading and support rails and connected to the first forward support, a second cross member connected to the second forward support, and a third cross member connected to the loading rail support means.

6. In a trailerable power boat having an inboard mounted engine, the improvement comprising:

(a) two elongated support rails extending substantially parallel to each other and spaced apart sufficiently to support opposite sides of the hull of a personal watercraft when the personal watercraft is aligned longitudinally with the support rails;

(b) two elongated loading rails, each loading rail connected to a different one of the support rails at an aft end of the respective support rail, the two loading rails spaced apart substantially the same distance as the support rails and extending substantially parallel to each other and each extending from the respective support rail downwardly at an acute angle with respect to the respective support rail;

(c) cross support means associated with both the support rails and the loading rails for fixing the support rails and loading rails in the spaced apart position;

(d) forward support means having a proximal end connected to the support rails and a distal end depending from the support rails;

(e) forward connector means associated with the distal end of the forward support means and connecting the distal end of the forward support means to the trailerable boat with the carrier in an operating position;

(f) loading rail support means having a proximal end connected to the loading rails and a distal end depending from the loading rails, the loading rail support means contacting an aft portion of the boat when the carrier is in operating position and with the aft end of the loading rails positioned beyond the stern of the boat and above the water line of the boat;

(g) aft connector means associated with the distal end of the loading rail support means for connecting the loading rail support means to the trailerable boat with the carrier in the operating position; and (h) slide means associated with the loading rails and the support rails for facilitating sliding contact between the hull of the personal watercraft and the loading rails and support rails longitudinally along said rails.

7. The apparatus of claim 6 further including:

(a) a forward stop structure connected to a forward end of the support rails, the forward stop structure for limiting the movement of the personal watercraft along the support rails at the ends of the support rails opposite the ends connected to the loading rails.

8. The apparatus of claim 7 further including:

(a) a winch connected to the forward stop structure and having a strap of sufficient length to extend from the forward stop structure to beyond the aft end of the loading rails.

9. The apparatus of claim 6 further comprising:

(a) a lifting member positioned between the loading rails and spaced forward from the aft end of the loading rails and below a plane defined by the loading rails.

10. The apparatus of claim 6 wherein:

(a) the forward support means includes a first forward support element depending from the support rails, and a second forward support element depending from the support rails in a spaced apart relation to the first forward support; and (b) the cross support means includes a first cross member extending transversely to the loading and support rails and connected to the first forward support, a second cross member connected to the second forward support, and a third cross member connected to the loading rail support means.

11. A method of loading a personal watercraft for transport across land:

(a) positioning the personal watercraft at the stern of a trailerable power boat having an inboard mounted engine, with the bow of the personal watercraft facing the stern of the trailerable boat;

(b) extending a winch strap from a winch mounted on the trailerable boat and connecting a distal end of the winch strap to the bow of the personal watercraft;

(c) winching the personal watercraft onto two parallel loading rails extending downwardly at the stern of the trailerable boat with an aft end of the loading rails positioned just above the water line of the trailerable boat and spaced from the stern of the boat, the parallel loading rails spaced apart sufficiently to support opposite sides of the personal watercraft longitudinally along the personal watercraft hull; and (d) winching the personal watercraft forward along the loading rails and onto two parallel support rails mounted above the aft section of the trailerable boat, and continuing to winch the personal watercraft forward until the support rails support the entire weight of the personal watercraft, the support rails being spaced apart sufficiently to support opposite sides of the personal watercraft hull.

12. The method of claim 11 wherein the step of winching the personal watercraft onto the loading rails includes:

(a) lifting the bow of the personal watercraft upwardly at the aft end of the loading rails by contact between the bow of the personal watercraft and a lifting member positioned forward of the aft end of the loading rails and below the loading rails, such contact occurring as the personal watercraft is winched toward the loading rails.

* * * * *

UNITED STATES PATENT AND TRADEMARK OFFICE

CERTIFICATE OF CORRECTION

PATENT NO. : 5,664,516

DATED : September 9, 1997

INVENTOR(S) : Gray Breeden

It is certified that error appears in the above-identified patent and that said Letters Patent is hereby corrected as shown below:

Title page, item [54] and col. 1,

In the title: Please change the title to read "Personal Watercraft Carrying Apparatus and Method For Trailerable Boats"

Signed and Sealed this

Eighteenth Day of November 1997

*Attest:*

Bruce Lehman

BRUCE LEHMAN

*Attesting Officer*

*Commissioner of Patents and Trademarks*